United States Patent [19]

Holden et al.

[11] Patent Number: 4,692,743

[45] Date of Patent: Sep. 8, 1987

[54] ALARM SYSTEM

[76] Inventors: Harold C. Holden; June Holden, both of Glen Dhoo Cottage Ballaugh Glen, Isle of Man

[21] Appl. No.: 787,404

[22] Filed: Oct. 15, 1985

[30] Foreign Application Priority Data

Apr. 6, 1984 [GB] United Kingdom ..... 84 08937

[51] Int. Cl.[4] ..... G08B 13/20

[52] U.S. Cl. ..... 340/544; 340/587; 364/400

[58] Field of Search ..... 340/544, 587; 364/558, 364/400; 200/83 B, 83 A

[56] References Cited

U.S. PATENT DOCUMENTS 2,745,089 5/1956 Levy ..... 340/544
3,829,851 8/1974 Evans et al. ..... 340/544
3,914,755 10/1975 Hook ..... 340/544
3,947,838 3/1976 La Forge, Jr. ..... 340/544

FOREIGN PATENT DOCUMENTS 3300906 7/1984 Fed. Rep. of Germany ..... 340/544
2157042 10/1985 United Kingdom ..... 340/544

*Primary Examiner*—Glen R. Swann, III
*Attorney, Agent, or Firm*—Caesar, Rivise, Bernstein, Cohen & Pokotilow, Ltd.

[57] ABSTRACT

An intruder alarm system in which intrusion into an enclosed space is detected as a change in the air pressure in the enclosed space uses a microcomputer to monitor the enclosed space by way of a sensor such that changes in air pressure are compared with a reference set at spaced intervals in dependence upon the ambient air pressure, whereby false alarms caused by changes in the weather are avoided.

6 Claims, 3 Drawing Figures

ALARM SYSTEM

BACKGROUND OF THE INVENTION

The invention relates to an alarm system, and in particular to an alarm system designed to protect an enclosed spaced and give warning that the space has been penetrated by an intruder. The space may be a domestic or commercial building, a room in such a building, a safe, a vault or the interior of a vehicle.

In U.S. Pat. No. 3,947,838 there is described an alarm system comprising a sensor responsive to air pressure within an enclosed space, the sensor providing electrical signals related to the sensed air pressure, and a signal processor to which the electrical signals are supplied and operative to initiate an alarm indication when the signal supplied by the sensor is indicative of an intrusion into the enclosed space.

In this known system the signal processor is operative to distinguish between signals supplied by the sensor indicative of an intrusion into the enclosed space and such signals deriving from changes in the air pressure in the enclosed space caused by changes in the ambient atmospheric conditions in and around the enclosed space. The signal processor effects such distinction between the different signals it receives in dependence upon the rate of change of the value of the signal, on the basis that intruder entry into the enclosed space cannot be accomplished in less than a minimum predetermined time and will be completed in less than a maximum predetermined time.

A disadvantage of this known system is that it is not completely compensated for changes in ambient atmospheric conditions and may therefore give a false alarm if such conditions change in an unexpected manner and give a rate of change of air pressure in the enclosed space similar to that produced by an intruder.

OBJECT OF THE INVENTION

Accordingly, it is the object of this invention to provide an alarm system which overcomes the disadvantages of the piror art.

SUMMARY OF THE INVENTION

According to this invention an alarm system comprises a sensor responsive to air pressure within an enclosed space, the sensor providing electrical signals related to the sensed air pressure, and a signal processor to which the electrical signals are supplied and operative to initiate an alarm indication when the signal supplied by the sensor is indicative of an intrusion in the enclosed space is characterised in that the signal processor is operative to cause the sensor to measure the air pressure in the enclosed space at intervals and to compare the measured value with a plurality of predetermined discrete narrow reference ranges of values and select the reference range within which the measured value lies, and also to cause the sensor to measure the air pressure in the enclosed space at other more frequent intervals and compare the measured value with the reference range selected at that time, an alarm indication being given if a value measured at one of the more frequent intervals lies outside the reference range selected at that time.

Preferably said intervals are separated by about two minutes and said more frequent intervals occur about fifty times per second.

With the system of the present invention the measurements made by the sensor at the relatively widely spaced intervals serve to determine the ambient atmospheric air pressure in the enclosed space and set the signal processor in dependence thereon, while the measurements made by the sensor at the more frequent intervals serve to indicate any change in the air pressure in the enclosed space from the ambient value caused by an intrusion into the enclosed space. Thus, the reference range of values selected at any time is characteristic of the ambient weather conditions and changes in weather conditions do not initiate a false alarm indication.

The invention further includes in another aspect a sensor which comprises a housing having a diaphragm mounted therein, the diaphragm forming one plate of each of a pair of capacitors the other plates of which are coupled to a comparator, movement of the diaphragm relative to the other plate caused by changes in air pressure applied to the sensor causing changes in the relative values of the capacitors, which changes cause the comparator to provide an output signal indicative of the air pressure applied to the sensor.

DESCRIPTION OF THE DRAWINGS

This invention will now be described by way of example with reference to the drawings, in which.

DESCRIPTION OF THE PREFERRED EMBODIMENT

Figure 1:
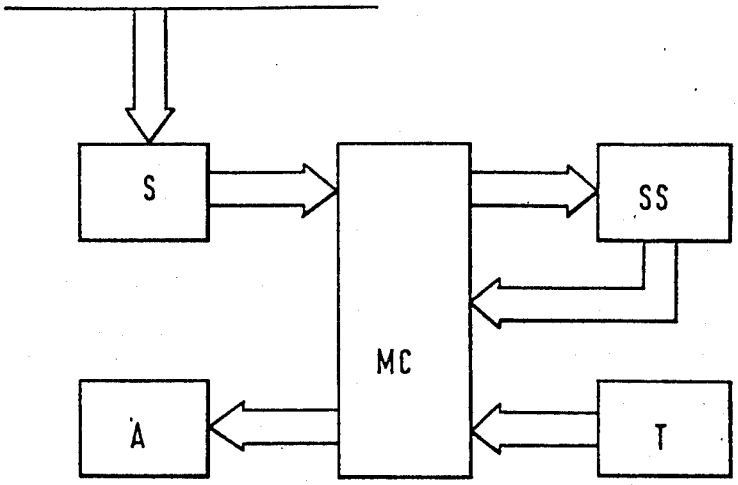
FIG. 1 is a block diagram of a system according to the invention.

The system shown in FIG. 1 comprises a sensor S which is arranged in an enclosed space to be monitored and responsive to the air pressure in that space to provide electrical signals indicative of the air pressure at any time. The sensor S is connected to a signal processor in the form of a microcomputer MC which is also connected to an alarm-giving device A, for example a siren. Operation of the system is controlled by a switch selector SS by which a unique four digit number has to be entered to render the system operative as required. Operation of the processor MC is controlled by a timer T, e.g. a counter timer circuit.

Figure 3:
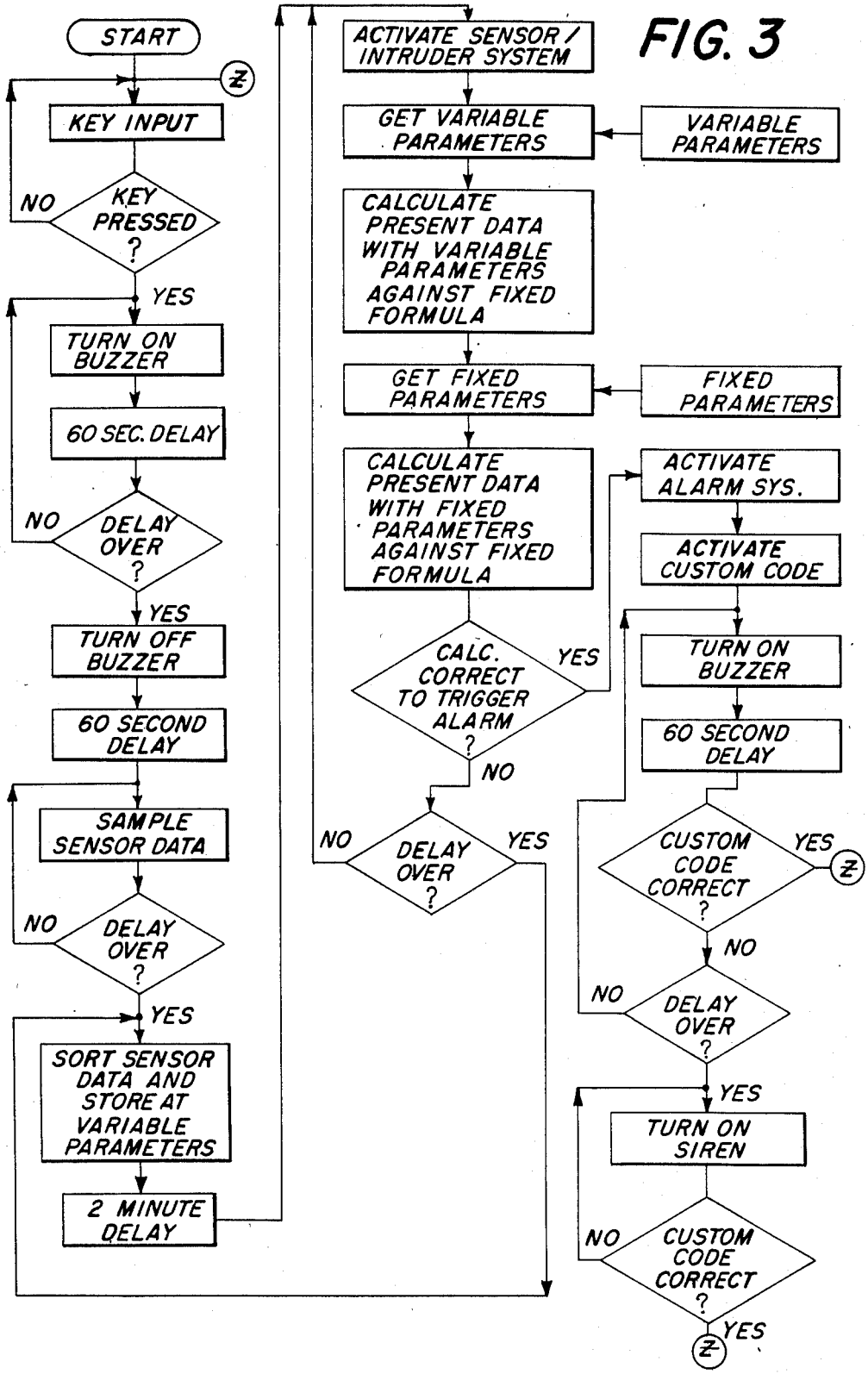
FIG. 3 is a flow chart illustrating the operation of the signal processor of the system of FIG. 1.

The system shown in FIG. 1 operates as shown in the flow chart of FIG. 3. Thus, if the system has been activated by the inputting of the appropriate key, a buzzer begins to sound for sixty seconds to enable the space being monitored to be evacuated by the person activating the system. After sixty seconds, the buzzer turns off and the system begins a sixty second cycle of sampling data provided by the sensor. In particular, the sensor provides a signal in millivolts and within the range of 0–2.55 volts to means, not shown, such as an analog to digital converter circuit, to convert the analog signal into a digital signal representing measured air pressure. This data signal is then operated on by the microprocessor in the "Sort Sensor Data and Store At Variable Parameters" routine to select in which of various ranges the measured air pressure value lies. That data is then stored in variable locations. Every two minutes the stored data is updated by the occurrence of an interrupt routine of very short (e.g., millisecond) duration.

The data signals are also operated on by the "Activate Sensor/Intruder System" routine. This routine operates at much more frequent intervals, e.g., fifty times per second, to evaluate the measured air pressure data with respect to the various reference ranges. In particular, the various parameters for the system are fetched and the present data is then calculated with those variables against a fixed formula in the system. Fixed parameters are then fetched and the present data then calculated with those parameters against a fixed formula and checked to indicate if there has been a sufficient change in air pressure indicative of an intrusion. If so, the alarm system is activated. If not, the activate sensor/intruder system routine goes through another series of operation.

The alarm system enables an authorized person to deactivate the system and hence preclude the generation of an alarm signal, e.g., a siren, within sixty seconds of the detection of an intrusion. To that end, the system includes a customized code number which, if the person gaining access to the protected area, enters into the system, will prevent the siren from sounding. In particular, a buzzer will commence sounding when the system senses an intrusion. The buzzer will sound for sixty seconds. If the correct code number is entered before the end of the sixty seconds, no siren will sound and the system will go back to its "start" state. If the correct code number is not entered before the end of the sixty seconds, the siren will turn on and remain on until the correct code number is entered to cause the system to go back to its "start" state.

Thus, any sudden change in the air pressure in the enclosed space caused by entry of an intruder will cause an alarm indication to be given while any gradual change in the air pressure caused by changes in the weather conditions will result in recalibration of the system to compensate for such change.

Figure 2:
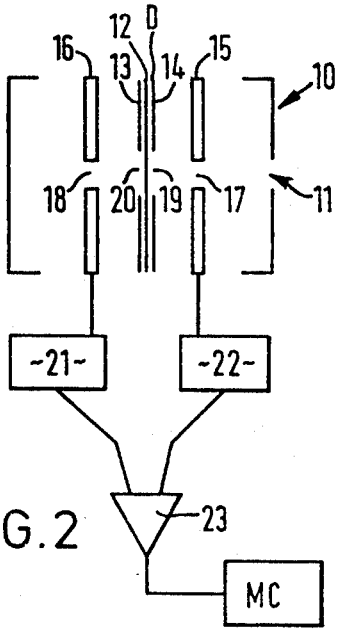
FIG. 2 is a diagrammatic representation of a sensor for use in the system of FIG. 1.

The sensor S shown in FIG. 2 comprises a housing 10 having an opening 11 in one end wall, and a diaphragm D comprising an aluminum foil 12 sandwiched between two metal plates 13, 14 which each constitute one plate of a respective capacitor, mounted across it at its centre. Arranged between the diaphragm D and the end walls of the housing 10 are printed circuit boards 15 and 16, respectively, which constitute the other plates of the capacitors. The printed circuit boards 15 and 16 have holes 17 and 18 respectively at their centres, aligned with the opening 11 in the housing 10, while the metal plates 13 and 14 of the diaphragm D have relatively large holes 20 and 19 at their centres.

The boards 15 and 16 are connected by way of coupling circuits 22 and 21 to a comparator 23 which is in turn connected to the processor MC.

Any sudden change in air pressure applied to the sensor causes movement of the diaphragm D relative to the boards 15 and 16 and thus a change in the capacitance of the capacitors formed between the metal plates 14 and 13 of the diaphragm D and the boards 15 and 16. Such change is detected by the comparator 23 which provides a signal indicative thereof, as a measure of the air pressure then prevailing in the enclosed space to the processor MC which in response thereto operates as above described.

Without further elaboration, the foregoing will so fully illustrate our invention that others may, by applying current or future knowledge, readily adopt the same for use under various conditions of service.

We claim:

1. An alarm system comprising a sensor responsive to air pressure within an enclosed space, the sensor providing electrical signals as a function of the sensed air pressure, and a signal processor to which the electrical signals are supplied and operative to initiate an alarm indication when the signal supplied by the sensor is indicative of an intrusion into the enclosed space, said alarm system being characterized in that the signal processor is operative to cause the sensor to measure the air pressure in the enclosed space at intervals and to compare the measured value with a plurality of predetermined discrete narrow reference ranges of values and select the reference range within which the measured value lies, and also to cause the sensor to measure the air pressure in the enclosed space at other more frequent intervals and compare the measured value with the reference range selected at that time, an alarm indication being given if a value measured at one of the more frequent intervals lies outside the reference range selected at that time.

2. A system is claimed in claim 1, characterized in that said intervals are separated by about two minutes.

3. A system as claimed in claim 2 characterized in that the said more frequent intervals occur about fifty times per second.

4. A system as claimed in claim 1 characterized in that the sensor is a capacitive effect device.

5. A system as claimed in claim 1, characterized in that the sensor comprises a housing having a diaphragm mounted therein, the diaphragm forming one plate of each of a pair of capacitors the other plates of which are coupled to a comparator, movement of the diaphragm relative to the other plate caused by changes in air pressure applied to the sensor causing changes in the relative values of the capacitors, which changes cause the comparator to provide an output signal indicative of the air pressure applied to the sensor.

6. A sensor for use in a system according to claim 1, characterized in that the sensor comprises a housing having a diaphragm mounted therein, the diaphragm forming one plate of each of a pair of capacitors the other plates of which are coupled to a comparator, movement of the diaphragm relative to the other plate caused by changes in air pressure applied to the sensor causing changes in the relative values of the capacitors, which changes cause the comparator to provide an output signal indicative of the air pressure applied to the sensor.

* * * * *